US005164265A

United States Patent [19]

Stubbs

[11] Patent Number: 5,164,265

[45] Date of Patent: Nov. 17, 1992

[54] ABRASIVE ELEMENTS

[75] Inventor: Roy Stubbs, Nuneaton, Great Britain

[73] Assignee: Minnesota Mining and Manufacturing Company, Saint Paul, Minn.

[21] Appl. No.: 615,142

[22] Filed: Nov. 19, 1990

[30] Foreign Application Priority Data

Dec. 11, 1989 [GB] United Kingdom ..... 8927983

[51] Int. Cl.[5] ..... B32B 27/08

[52] U.S. Cl. ..... 428/421; 427/407.1; 427/412.1; 428/323; 428/422

[58] Field of Search ..... 428/421, 422, 323; 427/407.1, 412.1

[56] References Cited

U.S. PATENT DOCUMENTS

| | | | |
|---|---|---|---|
| 2,050,992 | 8/1936 | Aust | 51/278 |
| 2,278,158 | 3/1942 | Ware | 51/295 |
| 2,768,886 | 10/1956 | Twombly | 51/295 |
| 2,780,534 | 2/1957 | Kuzmick et al. | 51/298 |
| 2,882,064 | 4/1959 | Morrison | 280/44 |
| 2,893,854 | 7/1959 | Rinker et al. | 51/298 |
| 3,042,508 | 7/1962 | Haigis et al. | 51/295 |
| 3,043,673 | 7/1962 | Klein et al. | 51/298 |
| 3,089,763 | 5/1963 | Gladstone | 51/295 |
| 3,779,727 | 12/1973 | Siqui et al. | 51/298 |
| 3,795,496 | 3/1974 | Greenwood | 51/295 |
| 3,868,232 | 2/1975 | Sioui et al. | 51/298 |
| 3,868,233 | 2/1975 | Carver et al. | 51/298 |
| 3,869,834 | 3/1975 | Mullin et al. | 51/295 |
| 3,997,302 | 12/1976 | Supkis | 51/295 |
| 4,343,628 | 8/1982 | Taylor | 51/298 |
| 4,720,941 | 1/1988 | Belieff et al. | 51/204 |
| 4,786,546 | 11/1988 | Vassiliou | 428/215 |

FOREIGN PATENT DOCUMENTS

| | | |
|---|---|---|
| 46-32912 | 9/1971 | Japan . |
| 2136011A | 2/1984 | United Kingdom . |

OTHER PUBLICATIONS

Abstract of Japanese JP56-69074, Jun. 1981.

*Chemical Abstracts*, vol. 100, No. 22, May 1984, p. 270, Abstract No. 179258y & JP-A-58 211 860 Sep. 12, 1983.

*Chemical Abstracts*, vol. 90, No. 4, Jan. 1979, p. 289, Abstract No. 28051z, & Ind. Diamond Rev. 1978 (may), 163-5.

*Primary Examiner*—Thomas J. Herbert, Jr.

*Attorney, Agent, or Firm*—Gary L. Griswold; Walter N. Kirn; Jeffrey L. Wendt

[57] ABSTRACT

An abrasive element comprising a substrate having on a surface thereof particles of an abrasive material secured by an organic binding medium wherein at least the surface of the element between the particles of abrasive material contains a fluorochemical selected from the group consisting of compounds comprising a fluorinated aliphatic group attached to a polar group or moiety and compounds having a molecular weight of at least 750 and comprising a non-fluorinated polymeric backbone having a plurality of pendant fluorinated aliphatic groups, said aliphatic groups comprising the higher of (a) a minimum of three C—F bonds, or (b) in which 25% of the C—H bonds have been replaced by C—F bonds such that the compound comprises at least 15% by weight of fluorine.

The compound may be applied as a layer coated over the existing layers of an abrasive element or it may be incorporated into at least the coating formulation which will form the outermost layer of the binding medium. The abrasive elements may be in the form of sheets, blocks, discs, pads, belts etc. The presence of the compound serves to reduce the loading of the abrading surface in use, thereby extending the working life of the abrasive element.

25 Claims, No Drawings

ABRASIVE ELEMENTS

FIELD OF THE INVENTION

This invention relates to abrasive materials and in particular to an abrasive element comprising an abrasive material having improved anti-loading properties.

BACKGROUND OF THE INVENTION

It is a well-known problem when abrading soft materials, especially painted surfaces, that the abrasive material becomes clogged with debris from the abraded surface. Harder materials abrade in the form of dust or easily removed discrete particles but softer materials can melt under the conditions of high temperature and pressure generated by the abrasion process to form a discontinuous coating on the abrasive surface. As the coating builds up, the abrasive material rapidly becomes unusable. This phenomenon is known as "loading" and is a particular problem when cellulose-based paints are involved, especially nitrocellulose paints which are commonly used on car bodies.

Various lubricants and surface treatments have been applied to abrasive materials in order to minimise loading problems, for example, as disclosed in U.S. Pat. Nos. 2,050,992, 2,278,158, 2,780,534, 2,882,064, 3,043,673, 3,089,763 and 3,795,496. The most commonly used lubricants are the metal salts of long chain fatty acids as disclosed in U.S. Pat. Nos. 2,768,886 and 2,893,854. The fatty acid metal salts are generally applied in combination with a binder and optional coating additives such as wetting agents, thickeners, defoamers etc., as a dispersion in either aqueous or organic media. Current preference is directed to aqueous formulations, for example, as disclosed in Japanese Patent Application No. 56-69074.

U.S. Pat. No. 3,042,508 discloses metal backed abraders formed by brazing tungsten carbide abrasive particles to a steel substrate with copper brazing metal. The abrasive surface is coated with a sintered layer of a polymer selected from polytetrafluoroethylene, polytrifluorochloroethylene and co-polymers thereof, cured to a hard durable coating by heat treatment, typically in excess of 250° F. The abraders are said to resist loading during use.

U.S. Pat. Nos. 3,779,727 and 3,868,232 disclose the use of poly(tetrafluoroethylene), poly(tetrafluoro ethylene-hexafluoropropylene) and fluorinated graphite as a solid lubricant for addition (in particulate form) to the binder matrix of grinding wheels and the size layer of abrasive belts and discs.

U.S. Pat. No. 3,868,233 discloses the use of poly(tetrafluoroethylene) as a solid lubricant for addition to the central core of cup-type grinding wheels.

U.S. Pat. No. 3,869,834 discloses the use of a surface deposit of poly(tetrafluoroethylene) or poly(trifluorochloroethylene) particles, either loosely or compactly applied, onto the cutting surface of abrasive belts and grinding wheels.

U.S. Pat. No. 4,343,628 discloses the use of poly(tetrafluoroethylene) or a copolymer of poly(tetrafluoroethylene-hexafluoropropylene) as a binder matrix for diamond containing grinding wheels.

U.S. Pat. No. 4,720,941 discloses the use of poly(tetrafluoroethylene) or poly(trifluorochloroethylene) as a binder matrix for abrasive elements such as grinding wheels and cups, abrasive discs, sheets and pads.

Japanese Patent No. 71-032912 discloses the addition of pulverised fluorinated resins such as poly(tetrafluoro ethylene) or a copolymer of poly(tetrafluoroethylene-hexafluoroethylene) to the size or supersize layer of abrasive cloths and paper.

There has now been found an abrasive material having improved anti-loading properties.

SUMMARY OF THE INVENTION

According to the present invention there is provided an abrasive element comprising a substrate having on a surface thereof particles of an abrasive material secured by an organic binding medium characterised in that at least the surface of the element between the particles of abrasive material contains a fluorochemical compound selected from compounds comprising a fluorinated aliphatic group attached to a polar group or moiety and compounds having a molecular weight of at least 750 and comprising a non-fluorinated polymeric backbone having a plurality of pendant fluorinated aliphatic groups, which aliphatic groups comprise the higher of (a) a minimum of three C—F bonds, or (b) in which 25% of the C—H bonds have been replaced by C—F bonds such that the fluorochemical compound comprises at least 15% by weight of fluorine.

Abrasive products are normally prepared by coating one surface of a substrate with a first binder layer having adhesive properties, often referred to in the art as the "make". Particles of abrasive material are applied to the coated substrate and partially embedded therein. A layer of a second binder, often referred to as the "size", is then applied to the material. The thickness of the second binder layer regulates the amount of the abrasive material extending above the binder medium. Anti-loading materials have generally been included in a further optional layer, referred to in the art as the "supersize".

The abrasive elements of the invention may comprise an inorganic, non-metallic binding medium, e.g., a silicate or ceramic based system, but more preferably comprise an organic, non-metallic binding medium.

The presence of a fluorochemical compound in at least the layer forming the exposed surface of the element is found to confer anti-loading properties upon the material so treated.

The fluorochemical compound may be applied as a layer coated over the existing layers of an abrasive element or may be incorporated into at least the composition which will form the outer layer. Thus, the fluorochemical compound may be incorporated into the make of an abrasive element consisting of a single layer; the fluorochemical compound may be incorporated into the size of an abrasive element consisting of a make and size layers or the fluorochemical compound may be incorporated into the supersize layer of an abrasive element consisting of a make, size and supersize layers. If more than one supersize layer is present the fluorochemical compound is incorporated into the outermost supersize layer. The fluorochemical compound is preferably present in a supersize layer.

DESCRIPTION OF THE PREFERRED EMBODIMENTS

The anti-loading materials used in the present invention are suitable for application to a wide variety of abrasive materials or products, serving to reduce the loading of the abrading surface in use and thereby extending the working life of the material. The abrasive elements may be in the form of sheets, blocks, discs, pads, belts and the like or rigid or flexible three-dimensional arrays of fibres, e.g., of the type commercially available from Minnesota Mining and Manufacturing Company under the Trade Mark SCOTCH-BRITE. Abrasive elements of the invention may be advantageously used under either dry or wet abrading conditions since the fluorochemical compound provides a degree of water repellancy.

The term "fluorochemical" compound used herein embraces both compounds having a molecular weight of at least 750 and other fluorinated materials. The latter generally comprise lower molecular weight fluorinated compounds and contain at least 15% (preferably 20%) by weight of fluorine, and are substantially involatile under atmospheric pressure at temperatures up to 50° C., preferably up to 100° C., most preferably up to 150° C. Such materials commonly comprise a fluorinated aliphatic group attached to a polar group or moiety such as carboxylic acid (and salts thereof), phosphoric acid (and salts thereof), sulphonic acid (and salts thereof), acid halide, sulphonyl halide, ether, ester, amide, sulphonamide, polyether, urethane, carbonate, urea, carbamate etc. Also included are compounds comprising two or more fluorinated aliphatic groups. Examples of such materials include those known under the tradenames FC-10, FC-26, FC-95, FC-128, FC-393, FC-805 and FC-807, commercially available from Minnesota Mining and Manufacturing Company.

Polymeric and oligomeric compounds having a molecular weight of at least 750, preferably at least 1000, comprising a polymeric or oligomeric backbone having a plurality of pendant fluoroaliphatic groups, are also useful anti-loading compounds in the present invention. The polymeric backbone may comprise any suitable homopolymer or co-polymer known to the art including, for example, acrylates, urethanes, polyesters and polycarbodiimides. Co-polymers of fluorinated and non-fluorinated monomers are also useful. Usually, the Polymeric and oligomeric compounds in this category have a minimum fluorine content of 15%, preferably 20% by weight, the fluorine being present on pendant groups. Thus highly insoluble polymers and copolymers of tetrafluoroethylene, hexafluoropropylene, chlorotrifluoroethylene, vinyl fluoride, vinylidene fluoride etc. are excluded from use in the invention.

Polymeric and oligomeric compounds having lower limit of molecular weight of 750 as above described preferably comprise an acrylate homopolymer or copolymer backbone supporting a number of fluoroaliphatic groups. The term acrylate is used in the generic sense and is intended to include not only derivatives of acrylic acid but also methacrylic acid and other modified acrylic acids.

Each acrylate monomer may possess one or more fluoroaliphatic groups in which the higher of (a) a minimum of three C—F bonds are present or (b) 25% of the C—H bonds have been replaced by C—F bonds. Each acrylate monomer incorporates at least one polymerisable vinyl group.

Typical polymers for use in the invention are derived from acrylate monomers of general formula (I):

$$R_f-(CH_2)_m-O-\overset{\overset{\displaystyle O}{\|}}{C}-\overset{\overset{\displaystyle X}{|}}{C}=CH_2 \qquad (I)$$

in which;

$R_f$ represents a fluoroaliphatic group,

X represents H or an alkyl group of from 1 to 5 carbon atoms, preferably $CH_3$, and, m is 0, 1 or 2.

The fluoroaliphatic group $R_f$ is generally a fluorinated, preferably saturated, monovalent, aliphatic group of at least two carbon atoms. The chain may be straight, branched, or, if sufficiently large, cyclic, and may be interrupted by oxygen atoms or nitrogen atoms bonded only to carbon atoms. A fully fluorinated group is preferred, but hydrogen or chlorine atoms may be present as substituents in the fluorinated aliphatic group; generally not more than one atom of either is present in the group for every two carbon atoms. Preferably the group contains a terminal perfluoromethyl group. Preferably, the fluorinated aliphatic group contains no more than 20 carbon atoms.

Specific examples of such compounds include:

1,1-dihydroperfluoro-octyl acrylate, 1,1-dihydroperfluoro-octyl methacrylate, 1,1-dihydroperfluoro-butyl acrylate, 1H,1H,5H-octafluoro-pentyl acrylate, 1H,1H,11H-eicosafluoro-undecyl acrylate, Hexafluoro-isopropyl acrylate, Perfluoropentyl acrylate.

The acrylates may also possess other atoms, e.g., sulphur and nitrogen, outside the fluoroaliphatic group. For example, fluorochemical compounds comprising monomers of general formula (II) may be employed:

$$R_fSO_2\overset{\overset{\displaystyle R}{|}}{N}-(CH_2)_qO-\overset{\overset{\displaystyle O}{\|}}{C}-\overset{\overset{\displaystyle X}{|}}{C}=CH_2 \qquad (II)$$

in which;

X is as defined above, $R_f$ represents a fluoroaliphatic group as above,

R represents hydrogen or an alkyl group, generally of 1 to 5 carbon atoms, and q is an integer from 1 to 11.

Specific examples of such compounds include:

2-(N-ethyl perfluoro octane sulphonamido)ethyl acrylate, 2-(N-ethyl perfluoro octane sulphonamido)ethyl methacrylate, 2-(N-butyl perfluoro octane sulphonamido)ethyl acrylate.

Mixtures of two or more fluorinated acrylates may also be employed.

A preferred class of fluorochemical compounds useful in the present invention are derived from perfluorooctylsulphonamidoethyl acrylate monomers, for example, the fluorochemical compounds commerically available under the trade designations FC-461 and FC-824 from the Minnesota Mining and Manufacturing Company.

The amount of fluorochemical compound applied to the abrasive element varies with the fluorochemical compound selected, the layer of incorporation and the grade of abrasive mineral to be treated. Normally, the fluorochemical compound is applied in an aqueous dispersion. The dry coating weight varies with the grade of abrasive and the formulation in which it is applied, and is generally in the range 5 mg/m$^2$ to 300 g/m$^2$. Generally the coarser the grade of abrasive, the greater the amount of fluorochemical compound included. The depth of coating employed depends upon whether the fluorochemical compound is in the size or supersize and what other layers are present.

In one embodiment the fluorochemical compound may be added to a supersize coating formulation. The supersize coating generally comprises an aqueous dispersion or solution of a binder material and the fluorochemical compound. Both binder and fluorochemical compound are normally formulated as an aqueous dispersion or emulsion, typically a 15 to 80% by solids aqueous dispersion or emulsion.

Supersize coatings are generally formulated according to the following amounts, in which;

(a) the binder generally comprises at least 0.5%, more preferably 1 to 80%, of the total solids of the composition, and, (b) the fluorochemical compound generally comprises at least 0.05%, more preferably 0.2 to 80%, of the total solids of the composition.

The supersize binder material may comprise any water-soluble or water-dispersable binder known to the art. Suitable binders include methyl cellulose, sodium carboxymethyl cellulose and more preferably an acrylic homopolymer or co-polymer latex. In a most preferred embodiment, the supersize binder comprises a styrene-acrylate co-polymer latex, commercially available from Vinyl Products Limited, under the trade designation VINACRYL 71322.

In an alternative embodiment the fluorochemical compound may be included within the size layer, thereby dispensing with the need for a supersize layer. Size coatings generally comprise an aqueous dispersion or solution of binder material and the fluorochemical compound. Size coatings are generally formulated according to the following amounts, in which:

(a) the binder comprises at least 20%, typically 35 to 99% of the total solids of the composition, and, (b) the fluorochemical compound comprises at least 0.05%, typically 0.2 to 5% of the total solids of the composition.

The size binder may comprise any water-soluble or water-dispersable binder known to the art. Suitable binders include formaldehyde based resins, such as amine formaldehydes, (e.g. melamine formaldehyde and urea formaldehyde), phenol formaldehyde, epoxy resins and blends thereof.

The size and supersize coatings of the invention are fully compatible with conventional anti-loading additives and advantageously may include one or more additives known to the art. A preferred additive comprises the salt of a fatty acid. The fatty acid salt is normally only added to the supersize coating and generally comprises from 40 to 99%, preferably 50 to 98% by weight of the total solids of the composition.

The fatty acid salt may comprise any fatty acid salt known to the art of anti-loading materials but is preferably a fatty acid salt of general formula (III):

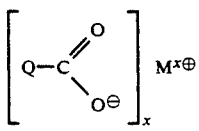

(III)

in which;

Q is a saturated or unsaturated hydrocarbon group having a chain length of from 9 to 30 skeletal carbon atoms, more preferably from 9 to 24 carbon atoms and most preferably from 11 to 17 carbon atoms, x has integral values from 1 to 4, and, M is a metal or ammonium cation.

Q preferably represents an alkyl chain selected from:

(i) $C_nH_{2n+1}$ to complete a fatty acid salt derived from an alkanoic acid;

(ii) $C_nH_{2n-1}$ to complete a fatty acid salt derived from an alkenoic acid;

(iii) $C_nH_{2n-3}$ to complete a fatty acid salt derived from an alkadienoic acid, and, (iv) $C_nH_{2n-5}$ to complete a fatty acid salt derived from an alkatrienoic acid, in which n has integral values from 9 to 30, more preferably 9 to 24 and most preferably 11 to 17.

M is preferably selected from Al, Zn, Mg, Ca, Ba, Na Li, Zr, Pb and $NH_4$.

The fatty acid salt may comprise a mixture of one or more salts. Preferred fatty acid salts comprise calcium laurate (calcium dodecanoate), calcium myristate (calcium tetradecanoate), calcium palmitate (calcium hexadecanoate), calcium stearate (calcium octadecanoate), calcium oleate (calcium octadecenoate) and mixtures thereof.

In a most preferred embodiment the salt comprises calcium stearate, commercially available as a 50% solids aqueous dispersion under the trade designation Nopco 1097A and Nopco 1097S from Henkel Nopco.

The supersize or size coating formulations of the invention may also include one or more additives known in the art, such as fillers, other stearates, thickeners, anti-static agents, defoamers, wetting agents and auxiliary pigments such as talc, $TiO_2$ and carbon black. Additives such as metal flakes, carbon black and graphite are particularly useful as they confer an anti-static effect on the abrasive material.

The fluorochemical compound containing layer may be coated using conventional methods known to the art, such as spraying or roller coating.

The coating procedure generally comprises the sequential coating of (1) the make, followed by the abrasive material, (2) the size and optionally (3) one or more supersizes.

Each layer is successively coated after drying of the previous layer. Drying of the fluorochemical compound containing layer is advantageously completed by heating. The drying temperature varies with the selected fluorochemical compound and the presence of additional binders. Generally, drying is completed by heating at elevated temperatures, e.g., 100° C., for a period of from 1 to 20 minutes or alternatively in a tunnel dryer heating for 1 to 60 seconds at higher temperatures, e.g., 120° C.

In addition to the anti-loading effect the coated layers incorporating a fluorochemical compound provide an additional benefit when applied to abrasive sheets having an adhesive layer coated on to the back of the support. When such materials are formed in a continuous roll, there is a tendency for "blocking" (sticking together) and "pick up" (transfer of the outer layer of one sheet to the adhesive coating of another). Both of these effects are minimised by the present invention.

Furthermore, the presence of the fluorochemical compound is found to impart a degree of water and oil repellency to the abrasive element and may allow the element to be used for wet abrading.

Anti-loading layer including a fluorochemical compound in accordance with the invention may be used with a wide variety of abrasive products. The abrasive may be any of the commonly used materials and of any grade (although the problem of loading is most severe with fine grades).

The invention will now be described with reference to the following Examples.

Anti-loading compositions of the invention were coated onto the following abrasive materials:

Base Material A comprising aluminium oxide abrasive mineral particles bound to a paper backing with a urea formaldehyde resin, Base Material B comprising aluminium oxide abrasive mineral particles bound to a polyester film backing with a phenol formaldehyde resin, An abrasive base known under the trade designation 3M 245 commercially available from Minnesota Mining and Manufacturing Company, and, An abrasive base known under the tradename 3M 314 commercially available from Minnesota Mining and Manufacturing Company.

After coating the base material was cut into abrasive discs in a conventional manner. Other materials utilised in the Examples are:

| | Manufacturer | Description |
|---|---|---|
| Binders* | | |
| Vinacryl 71350 | Vinyl Products Ltd. | Styrene-acrylate copolymer emulsion |
| Vinacryl 71322 | Vinyl Products Ltd. | Styrene-acrylate copolymer emulsion |
| Vinacryl 4039 | Vinyl Products Ltd. | Acrylate-emulsion |
| Vinamul 7700 | Vinyl Products Ltd. | Styrene-emulsion |
| Vinamul 3525 | Vinyl Products Ltd. | Vinylacetate-Vinylchloride-Ethylene terpolymer emulsion |
| PL 6373 | Polysar | Styrene-acrylate copolymer emulsion with an anionic emulsifier |
| Primal E581 | Rohm & Haas | Acrylate emulsion |
| Primal TR407 | Rohm & Haas | Acrylate emulsion |
| B-85 | Rohm & Haas | Acrylate emulsion |
| Cymel 303 | American Cyanamid | Melamine formaldehyde resin |
| Fluorochemicals* | | |
| FC-217 | Minnesota Mining & Manufacturing Co. | Fluorochemical-acrylate dispersion |
| FC-233B | Minnesota Mining & Manufacturing Co. | Fluorochemical-urethane dispersion |
| FC-248 | Minnesota Mining & Manufacturing Co. | Fluorochemical-acrylate dispersion |
| FC-352 | Minnesota Mining & Manufacturing Co. | Fluorochemical-polycarbodiimide dispersion |
| FC-393 | Minnesota Mining & Manufacturing Co. | Fluorochemical-adipate dispersion |
| FC-396 | Minnesota Mining & Manufacturing Co. | Fluorochemical ester/acrylate blend |
| FC-461 | Minnesota Mining & Manufacturing Co. | Fluorochemical acrylate dispersion |
| FC-807 | Minnesota Mining & Manufacturing Co. | Fluorochemical ester solution |
| FC-810 | Minnesota Mining & Manufacturing Co. | Fluorochemical acrylate dispersion |
| FC-824 | Minnesota Mining & Manufacturing Co. | Fluorochemical acrylate dispersion |
| Fatty Acids* | | |
| Nopco 1097A | Henkel Nopco | Calcium stearate dispersion |
| Nopco 1097S | Henkel Nopco | Calcium stearate dispersion |
| Harcros MK8 | Durham Chemicals | Zinc stearate dispersion |

-continued

| | Manufacturer | Description |
|---|---|---|
| Lithium Stearate | Durham Chemicals | Lithium stearate |
| Calcium Stearate A | Durham Chemicals | Calcium stearate |
| Zinc Stearate NB/60M | Witco | Zinc stearate dispersion |
| Miscellaneous* | | |
| Aerosol OT | American Cyanamid | Wetting Agent |
| Anti-terra P | B.Y.K. | Wetting Agent |
| Raven M | Columbia Chemical Company | Carbon Black |
| Defoamer 1512M | Hercules | Defoaming Agent |
| Cab-O-Sil | Tenants | Fumed Silica |
| Acrysol TT615 | Rohm & Haas | Thickening Agent |
| Acrysol G-75 | Rohm & Haas | Thickening Agent |
| 2K-Refinish Paint | Berger Industrial Coatings | Refinish paint |
| Autonova Primer | Sikkens | Primer |
| No-fil Adalox A273 | Norton | Abrasive Material |

*trade designation used by the listed manufacturer for the described chemical.

EXAMPLE 1

In this Example, abrasive discs of Base Material A (Grade P320) having a coating composition according to the invention were compared with 3M 212 discs (Grade P320) identical to Base Material A but coated with a proprietary stearate-based anti-loading composition. The 3M 212 discs are commercially available from the Minnesota Mining and Manufacturing Company under the trade name 'PRODUCTION FRECUT'.

Abrasive discs of the invention were coated in a conventional manner on a laboratory roller coater with the following coating formulation at about 10 g/m$^2$ dry coating weight.

FORMULATION 1

(i) styrene-acrylate polymer emulsion tradename Vinacryl 71322: 5.0 parts by weight (ii) calcium stearate dispersion (tradename Nopco 1097A): 25.0 parts by weight (iii) fluorochemical ester/acrylate blend (tradename FC-396): 0.25 parts by weight.

The performance of the coated discs was evaluated by abrading a test panel of mild steel primed and painted with a cellulose-based paint in a conventional manner. Separate 24 square inches portions were sanded by discs of both types under identical conditions.

The control disc started to load up after only 7 seconds and did not cut through the top coat to the primer. The control disc was completely clogged with paint after 40 seconds and had stopped cutting.

The disc coated with Formulation 1 of the invention sanded the entire 24 square inches removing all of the top coat in 1 minute 10 seconds, without clogging.

In a further test a panel of mild steel was primed with primer (tradename Autonova) and test areas sanded for 3 minutes using a sander known under the tradename Desoutter D/A Sander equipped with the control disc and disc of the invention. The performance of each disc is detailed in Table 1:

TABLE 1

| Formulation | Initial Loading Noticed (Seconds) | Substantial Clogging Noticed (Minutes) | Cutting Stopped (Minutes) | Area Sanded ($cm^2$) |
|---|---|---|---|---|
| Control | 30 | 1.5 | 2.5 | 15.6 |
| 1 | 50 | 2.25 | >3.0 | 27.6 |

EXAMPLE 2

This Example illustrates the improvement in antiloading properties conferred by treatment of an abrasive material with a fluorochemical-containing coating formulation according to the invention.

The following coating formulations were prepared:

Formulation 2: styrene-acrylate copolymer emulsion with an anionic emulsifier known under the tradename PL 6373 (5 grams), fluorochemical acrylate dispersion known under the tradename FC-824 (5 grams), fumed silica known under the tradename Cab-O-Sil (1 gram), calcium stearate known under the trade designation calcium stearate A (10 grams), and two drops each of wetting agent known under the tradename Aerosol OT and a defoaming agent known under the tradename Defoamer 1512M were added to forty grams of water.

Control Formulation: as per Formulation 2 but with no fluorochemical and styrene-acrylate copolymer emulsion with an anionic emulsifier known under the trade designation PL-6373 (10 g).

Each formulation was hand coated onto Base Material A (Grade P240) abrasive discs and dried for ten minutes at 50° C. The performance of the coated discs was evaluated by abrading a test panel representative of a a car body panel from an automobile known under the tradename "Rover" for 1 minute in a similar manner to Example 1. Discs coated with Formulation 2 removed an area of paint 20% in excess of that removed by the discs coated with the Control Formulation and were visibly less loaded following testing.

EXAMPLE 3

The following coating formulations were prepared:

Formulation 3: acrylate emulsion known under the tradename Primal TR407 (25 grams), fluorochemical acrylate dispersion known under the trade designation FC-824 (25 grams), and calcium stearate known under the trade designation calcium stearate A (10 grams) in water (10 grams).

Control Formulation: acrylate emulsion known under the tradename Primal TR407 (50 grams), calcium stearate known under the trade designation calcium stearate A (10 grams), and fumed silica known under the trade designation Cab-O-Sil (1 gram).

Each formulation was hand coated onto Base Material A (Grade P240) abrasive discs and dried for ten minutes at 50° C. The performance of the coated discs was evaluated as in Example 2.

Discs coated with Formulation 3 removed at least three times the area of paint removed by discs coated with the Control Formulation and were visibly less loaded following testing.

EXAMPLE 4

The coating formulations of Table 2 were prepared:

TABLE 2

| Formulation | Composition |
|---|---|
| Control | acrylate emulsion, trade designation Primal TR407 (10 g) + calcium stearate dispersion, trade designation Nopco 1097A (50 g) |
| 4 | Control (50 g) + fluorochemical acrylate dispersion, trade designation FC-824 (0.5 g) |
| 5 | Formulation 4 (45.5 g) + fluorochemical acrylate dispersion, trade designation FC-824 (0.5 g) |
| 6 | Formualtion 5 (41.4 g) + fluorochemical acrylate dispersion, trade designation FC-824 (1.0 g) |
| 7 | Formulation 6 (36.1 g) + fluorochemical acrylate dispersion, trade designation FC-824 (5.0 g) |
| 8 | acrylate emulsion, trade designation Primal TR407 (20 g) + fluorochemical acrylate dispersion, trade designation FC-824 (1 g) |
| 9 | Formulation 8 (18.9 g) + fluorochemical acrylate dispersion, trade designation FC-824 (1 g) |

Each formulation was hand coated onto Base Material A (Grade P240) abrasive discs and dried for 1 minute at 100° C. The performance of each disc was evaluated by flat sanding (whole area of disc in contact with panel) and edge sanding (perimeter of disc in contact with panel) a mild steel test panel coated with a cellulose-based paint for 5 seconds using a sander known under the trade designation Desoutter D/A Sander. Visual inspection of the discs both during and after testing revealed that discs coated with the Control Formulation loaded more rapidly and were inferior to discs coated with Formulations 4 to 9, incorporating FC-824. Discs coated with Formulations 8 and 9 accumulated large agglomerates of cellulose paint which were shed as the test proceeded. Discs coated with Formulations 4 to 7 remained substantially free from debris throughout the test.

EXAMPLE 5

The coating formulations of Table 3 were prepared:

TABLE 3

| Formulation | Composition |
|---|---|
| Control | An aqueous dispersion (25% by solids) of cellulose binder, zinc stearate, filler, a wetting agent and a defoaming agent |
| 10 | Control (313 g) + fluorochemical acrylate dispersion, trade designation FC-824 (15.65 g) |
| 11 | Formulation 10 (268 g) + fluorochemical acrylate dispersion, trade designation FC-824 (28.8 g) |
| 12 | acrylate emulsion, trade designation Primal TR407 (5 g) + calcium stearate dispersion, trade designation Nopco 1097A (25 g) + fluorochemical acrylate dispersion, trade designation FC-824 (0.4 g) |
| 13 | acrylate emulsion, trade designation Primal TR407 (5 g) + calcium stearate dispersion, trade designation Nopco 1097A (25 g) + fluorochemical acrylate dispersion, trade designation FC-824 (1.2 g) |

Each formulation was hand coated onto Base Material A (Grade P240) abrasive discs and dried for 3 minutes at 100° C. The performance of each disc was evaluated by abrading a mild steel test panel coated with a cellulose-based paint. The results are presented in Table 4.

TABLE 4

| Formulation | Visual Observations of Discs After Testing: Flat Sanding (5 seconds) Size of Debris[1] (mm) | Degree of Loading[2] | Appearance of Disc Centre | Edge Sanding (10 seconds) Size of Debris[1] (mm) | Adhesion of Debris | Degree of Loading[2] |
|---|---|---|---|---|---|---|
| Control | 3 | Moderate | Dusted | 3 | Well adhered | Heavy-moderate |
| 10 | 3 | Moderate | Dusted | 2-3 | Loose | Moderate |
| 11 | 3 | Moderate | Dusted | 2 | Loose | Moderate |
| 12 | 0.5 | Light | Very lightly dusted[3] | 0.5 | Loose | Moderate-light |
| 13 | 0.5 | Light | Very lightly dusted[3] | 0.5 | Loose | Moderate-light |

[1]Size of debris particles adhering to the disc.
[2]Loading was visually assessed into categories: light, moderate or heavy.
[3]Still cutting well after the test period.

EXAMPLE 6

This Example compares the Control disc of Example 1 Grade P240) with an abrasive disc of Base Material A (Grade P240) coated with Formulation 13 of Example 5. The performance of both types of coated disc was evaluated by sanding a mild steel test panel coated with 2K-refinish paint. The panel was sub-divided into two sections with masking tape and each side sequentially blanked with paper whilst the other half was abraded with the coated disc under evaluation. A visual inspection of the discs revealed that the disc coated with Formulation 13 exhibited superior anti-loading properties when compared with the Control disc. The abraded panel was sprayed with 2K-refinish paint with no visual defects in the surface coating.

A further test was conducted by abrading areas of a test panel coated with a cellulose-based paint (spray coated 3 hours prior to sanding), and a visual inspection of the discs revealed the disc coated with Formulation 13 exhibited superior anti-loading properties when compared to the Control.

EXAMPLE 7

The following coating formulations were prepared:

Control A: the Control disc of Example 1 (Grade P240).

Formulations 14 to 22: as detailed in Table 5, in which:

A=Urea formaldehyde resin (UF)

B=UF hardener (aqueous ammonium chloride/ammonia)

C=styrene-acrylate copolymer emulsion, trade designation Vinacryl 71322

D=acrylate emulsion, trade designation B-85

E=calcium stearate dispersion, trade designation Nopco 1097A

F=fluorochemical acrylate dispersion, trade designation FC-824

G=fluorochemical ester solution, trade designation FC-807

H=fluorochemical-acrylate dispersion, trade designation FC-248

TABLE 5

| Formulation | Weight (g) A | B | C | D | E | F | G | H |
|---|---|---|---|---|---|---|---|---|
| 14 | 15 | 1.5 | — | — | 25 | 0.5 | — | — |
| 15 | 10 | 1.0 | — | — | 25 | 0.25 | — | — |
| 16 | 5 | 0.5 | — | — | 25 | 0.38 | — | — |
| 17 | 15 | 1.5 | — | — | 25 | 0.25 | — | — |
| 18 | 5 | 0.5 | — | — | 25 | 0.25 | — | — |

TABLE 5-continued

| Formulation | Weight (g) A | B | C | D | E | F | G | H |
|---|---|---|---|---|---|---|---|---|
| 19 | — | 0.33 | — | 5 | 25 | 0.25 | — | — |
| 20 | — | — | 5 | — | 25 | 0.25 | — | — |
| 21 | — | — | 5 | — | 25 | — | 0.25 | — |
| 22 | — | — | 5 | — | 25 | — | — | 0.25 |
| Control B | — | — | 5 | — | 25 | — | — | — |

Each formulation was hand coated onto Base Material A (Grade P240) abrasive discs and dried for 10 minutes at 110° C. The performance of each disc was evaluated by abrading a test panel coated with a cellulose-based paint as described in Example 1.

A visual inspection of the discs after testing revealed that discs coated with Formulations 14 to 22 exhibited a superior anti-loading performance compared to Control A. Discs coated with Formulations 14 to 19 containing an amine-formaldehyde resin binder loaded more readily than discs coated with Formulations 20 to 22 containing an acrylate-based binder. Of the acrylate-binder containing dispersions, Formulation 20 containing fluorochemical acrylate dispersion, trade designation FC-824 was shown to provide the greatest resistance to loading. Discs coated with Formulations 20 to 22 were superior to discs coated with Control B which contained the acrylate binder but no fluorinated polymer.

EXAMPLE 8

Coating formulations of Table 6 were prepared:

Control: the Control disc of Example 1 (Grade P320).

TABLE 6

| Formulation | Composition |
|---|---|
| 23 | styrene-acrylate copolymer emulsion, trade designation Vinacryl 71322 (5 g) + calcium stearate dispersion, trade designation Nopco 1097A (25 g) + FC-824 (0.25 g) |
| 24 | Formulation 23 (30.25 g) + carbon black known under the trade designation Raven M Carbon Black (3.25 g)* |
| 25 | Formulation 24 (33.5 g) + wetting agent known under the trade designation Anti-terra P (0.3 g)* |
| 26 | Formulation 25 (33.8 g) + thickening agent, trade designation Acrysol G-75 (0.7 g) |
| 27 | acrylate emulsion, trade designation Primal E581 (5 g) + melamine formaldehyde resin, trade designation Cymel 303 (0.5 g) + calcium stearate dispersion, trade designation Nopco 1097A (25 g) + fluorochemical acrylate dispersion, trade |

TABLE 6-continued

| Formulation | Composition |
|---|---|
| | designation FC-824 (0.25 g) |

*Sufficient water was added to adjust the formulation to a suitable coating viscosity in the range 300 to 800 cP.

Each formulation was hand coated onto Base Material A (Grade P320) abrasive discs and dried for 5 minutes at 110° C. The performance of each disc was evaluated by abrading a test panel coated with a cellulose-based paint as described in Example 1.

A visual inspection of the discs after testing revealed that discs coated with Formulations 23 to 27 were visibly superior to the Control.

EXAMPLE 9

The coating formulations of Table 7 were prepared:

Control: as per the Control disc of Example 1 (Grade P320), but comprising Base Material B abrasive substrate.

TABLE 7

| Formulation | Composition |
|---|---|
| 28 | styrene acrylate copolymer emulsion Vinacryl 71322 (5 g) + calcium stearate dispersion, trade designation Nopco 1097A (25 g) + FC-824 (0.25 g) |
| 29 | styrene acrylate copolymer emulsion Vinacryl 71322 (5 g) + calcium stearate dispersion, trade designation Nopco 1097A (25 g) + FC-461 (0.25 g) |
| 30 | styrene acrylate copolymer emulsion Vinacryl 71322 (5 g) + calcium stearate dispersion, trade designation Nopco 1097A (25 g) + FC-810 (0.25 g) |
| 31 | Formulation 30 (21 g) + thickening agent, trade designation Acrysol TT615 (0.08 g) |
| 32 | Forumlation 28 (17 g) + thickening agent, trade designation Acrysol G-75 (0.05 g) |

Each formulation was laboratory roller coated onto Base Material B (Grade P320) abrasive discs and dried for 5 minutes at 110° C. The performance of each coated disc was evaluated by sanding on the following substrates:

(i) a mild steel panel coated with a cellulose-based paint;
(ii) an oak panel;
(iii) a panel representative of a car body panel from an automobile known under the trade designation Rover, and,
(iv) a panel representative of a car body panel such as a car body panel from an automobile known under the trade designation Fiat.

A visual inspection of the discs after testing revealed that discs coated with Formulations 28 to 32 exhibited superior anti-loading properties to the Control.

EXAMPLE 10

The coating formulations of Table 8 were prepared:

Control: the Control disc of Example 1 (Grade P320).

TABLE 8

| Formulation | Composition |
|---|---|
| 33 | styrene-acrylate copolymer emulsion, trade designation Vinacryl 71322 (5 g) + calcium stearate dispersion, trade designation Nopco 1097A (25 g) + fluorochemical acrylate dispersion, trade designation FC-810 (0.25 g) + thickening agent, trade designation Acrysol TT615 (0.08 g) |
| 34 | Formulation 33 (33.33 g) + Lithium stearate (6 g) + $H_2O$ (3 g) |

Each formulation was coated onto:

(a) Base Material A (Grade P320) abrasive discs, and,
(b) abrasive disks known under the trade designation 3M 314 (Grade P400).

The performance of each disc was evaluated by testing on the following substrates:

(i) a panel representative of a car body panel such as that from an automobile known under the trade designation Rover;
(ii) a panel representative of a car body panel such as that derived from an automobile known under the trade designation Fiat;
(iii) a mild steel panel coated with a cellulose-based paint.

A visual inspection of the discs after testing revealed that discs coated with Formulations 33 and 34 exhibited a superior anti-loading performance compared to the Control. Discs coated with Formulation 34 were less susceptible to loading than discs coated with Formulation 33.

EXAMPLE 11

The coating formulations of Table 9 were prepared:

TABLE 9

| Formulation | Composition |
|---|---|
| 35 | styrene-acrylate copolymer emulsion, trade designation Vinacryl 71322 (5 g) + calcium stearate dispersion, trade designation Nopco 1097A (25 g) + FC-810 (0.25 g) |
| 36 | styrene-acrylate copolymer emulsion, trade designation Vinacryl 71322 (5 g) + Zn Stearate - dispersion, trade designation NB/60M (25 g) + fluorochemical acrylate dispersion, trade designation FC-810 (0.25 g) |
| 37 | Formulation 35 (30.25 g) + thickening agent, trade designation Acrysol TT615 (0.08 g) |

Control: the Control disc of Example 1 (Grade P320).

Each Formulation was coated onto Base Material A (Grade P320) abrasive discs. The performance of each disc was evaluated by testing on:

(i) a mild steel panel coated with a cellulose-based paint, and,
(ii) a mild steel panel coated with 2K-refinish paint.

A visual inspection of the discs after the testing revealed that discs coated with Formulations 35 to 37 exhibited a superior anti-loading performance to the Control.

EXAMPLE 12

The coating formulations of Table 10 were prepared:

Control: the Control disc of Example 1 (Grade P320).

TABLE 10

| Formulation | Composition |
|---|---|
| 38 | styrene-acrylate copolymer emulsion, trade designation Vinacryl 71322 (5 g) + calcium stearate dispersion, trade designation Nopco 1097A (25 g) + fluorochemical acrylate dispersion, trade designation FC-810 (0.25 g) |
| 39 | styrene-acrylate copolymer emulsion, trade designation Vinacryl 71322 (5 g) + calcium stearate dispersion, trade designation Nopco 1097S (25 g) + fluorochemical acrylate dispersion, trade designation FC-810 (0.25 g) |
| 40 | styrene-acrylate copolymer emulsion, trade designation Vinacryl 71322 (5 g) + calcium stearate dispersion, trade designation Nopco 1097A (25 g) + lithium stearate (6 g) + fluorochemical acrylate dispersion, trade designation |

TABLE 10-continued

| Formulation | Composition |
|---|---|
| | FC-810 (0.25 g) |
| 41 | styrene-acrylate copolymer emulsion, trade designation Vinacryl 71322 (5 g) + calcium stearate dispersion, trade designation Nopco 1097A (25 g) + FC-396 (0.25 g) |
| 42 | styrene-acrylate copolymer emulsion, trade designation Vinacryl 71322 (7.5 g) + calcium stearate dispersion, trade designation Nopco 1097A (25 g) + zinc stearate (6 g) + fluorochemical acrylate dispersion, trade designation FC-810 (0.25 g)* |
| 43 | Formulation 42 (30.25 g) + thickening agent, trade designation Acrysol TT615 (0.08 g) |

*Sufficient water was added to adjust the formulation to a suitable coating viscosity within the range 300 to 800 cP.

Each formulation was hand coated onto Base Material A (Grade P320) abrasive discs and dried for 5 minutes at 110° C. The performance of each disc was evaluated by testing on:

(i) a mild steel panel coated with a cellulose-based paint, (ii) a panel representative of a an automobile body from an automobile known under the trade designation Rover, and, (iii) an oak panel.

A visual inspection of the discs after testing revealed that discs coated with Formulations 38 to 43 exhibited a superior anti-loading performance compared to the Control.

EXAMPLE 13

The coating formulations of Table 11 were prepared:

TABLE 11

| Formulation | Composition |
|---|---|
| 44 | styrene-acrylate copolymer emulsion, trade designation Vinacryl 71350 (5 g) + calcium stearate dispersion, trade designation Nopco 1097A (25 g) + fluorochemical ester/acrylate blend, trade designation FC-396 (0.25 g) |
| 45 | styrene-acrylate copolymer emulsion, trade designation Vinacryl 71322 (5 g) + calcium stearate dispersion, trade designation Nopco 1097A (25 g) + fluorochemical ester/acrylate blend, trade designation FC-396 (0.25 g) |
| 46 | styrene-acrylate copolymer emulsion, trade designation Vinacryl 71350 (5 g) + calcium stearate dispersion, trade designation Nopco 1097A (25 g) + fluorochemical acrylate dispersion, trade designation FC-461 (0.25 g) |

Control Formulation: the Control disc of Example 1 (Grade P320).

Each Formulation was hand coated onto Base Material A (Grade P320) abrasive discs and dried for 2½ minutes at 110° C. Formulation 46 was additionally coated onto abrasive disks known under the trade designation 3M 245 (Grade P40).

The performance of each of the Grade P320 discs was evaluated by abrading the following substrates:

(i) a mild steel panel coated with a cellulose-based paint, and, (ii) a panel representative of a car body panel such as a panel from an automobile known under the trade designation Rover.

The coated abrasive disk known under the trade designation 3M 245 was tested on a glass fibre panel having a gel coating of hardened polyester resin and compared with a control disc comprising an untreated 3M 245 abrasive disc.

A visual inspection of the discs after testing revealed that discs coated with Formulations 44 to 46 exhibited superior anti-loading properties compared to the Control. The abrasive disk known under the trade designation 3M 245 coated with Formulation 46 produced superior anti-loading properties compared with the untreated disc.

EXAMPLE 14

This Example serves to illustrate the wide range of fluorochemicals which may be incorporated in anti-loading compositions of the invention.

A premix was made up comprising: styrene-acrylate copolymer emulsion Vinacryl 71322 (55 g), calcium stearate dispersion, trade designation Nopco 1097A (275 g).

FORMULATION 47

To 30 g of premix was added 0.25 g of fluorochemical-acrylate dispersion, trade designation FC-217 (cationic-dispersion).

FORMULATION 48

To 30 g of premix was added 0.25 g of FC-217 (anionic-dispersion).

FORMULATION 49

To 30 g of premix was added 0.25 g of fluorochemical-urethane dispersion FC-233B (cationic-dispersion).

FORMULATION 50

To 30 g of premix was added 0.3 g of FC-233B (anionic-dispersion).

FORMULATION 51

To 30 g of premix was added 0.25 g of fluorochemical-polycarbodiimide dispersion, trade designation FC-252B (cationic-dispersion).

FORMULATION 52

To 30 g of premix was added 0.25 g of fluorochemical-polycarbodiimide dispersion, trade designation FC-352 (anionic-dispersion).

FORMULATION 53

To 30 g of premix was added 0.25 g of fluorochemical-adipate dispersion, trade designation FC-393 (cationic-dispersion).

FORMULATION 54

To 30 g of premix was added 0.25 g of fluorochemical ester/acrylate blend, trade designation FC-396.

Each formulation was hand coated onto Base Material A (Grade P400) abrasive discs and dried for 2 minutes at 110° C. A control disc was coated with premix having no fluorochemical additive and dried as above. The performance of each coated disc was evaluated by abrading:

(i) a mild steel panel coated with a cellulose-based paint, and, (ii) a panel representative of a car body panel such as that from an automobile known under the trade designation Rover.

A visual inspection of the discs after testing revealed that discs coated with Formulations 47 to 54 exhibited superior anti-loading properties compared to the control disc coated with the premix alone.

EXAMPLE 15

The abrasive disc coated with Formulation 54 from Example 14 was mounted on an air-powered disc sander. The performance of the coating was evaluated by abrading a paint coated test panel, wetted with water both before and during cutting. The coated disc performed well, cutting an area approximately twice that of a control comprising the Control disc of Example 1 (Grade P400).

EXAMPLE 16

This Example demonstrates the application of anti-loading compositions of the invention to the size layer of an abrasive material.

The following mixes were coated onto an abrasive material comprising aluminium oxide abrasive mineral particles bonded to a paper substrate with urea formaldehyde resin.

Control Mix: Phenol formaldehyde resin (48 g)+water (30 g).

Size Mix 1: Control (58.8 g)+fluorochemical ester/acrylate blend FC-396 (0.02 g).

Size Mix 2: Mix 1 (48 g)+fluorochemical ester/acrylate blend FC-396 (0.09 g).

Size Mix 3: Mix 2 (39.7 g)+fluorochemical ester/acrylate blend FC-396 (0.26 g).

The coated materials were cured at 105° C. for 2½ hours. At this point abrasive materials coated with Size Mixes 2 and 3 did not wet following testing with a test kit known under the trade designation SCOTCHGARD Wettability Test Kit 3W, commercially available from Minnesota Mining and Manufacturing Company. SCOTCHGARD is a Registered trade name. Samples of each coated material were affixed to rubber sanding blocks and the performance of each material evaluated by hand sanding a mild steel test panel coated with a nitrocellulose-based paint. Abrasive materials coated with Mixes 2 and 3 exhibited superior anti-loading properties compared to the abrasive material coated with the Control Mix and Mix 1.

EXAMPLE 17

This Example demonstrates the improvement in anti-loading properties conferred by treating abrasive discs known under the trade designation No-fil Adalox A273, commercially available from Norton Chemical Co., with a fluorochemical-containing coating formulation in accordance with the invention.

The super-size layer containing a conventional metal stearate lubricant was removed from Norton No-fil Adalox A273 abrasive discs (180-A and 320-A). Each abrasive disc was then coated with a mix of Formulation 1 as described in Example 1 and the coated disc dried for 10 minutes at 110° C. Control discs of coated abrasive known under the trade designation Norton A273 were similarly heated for 10 minutes at 110° C. The performance of both the treated discs and the control discs was evaluated by abrading a mild steel test panel coated with a cellulose-based paint as described in Example 1. The results are presented in the Tables below.

(a) A coated abrasive disc known under the trade designation No-fil Adalox A273, having six holes and using grade 180-A abrasive grains, fitted with a loop and hook type attachment, was attached to an abrading device known under the trade designation ORKA ROA1 D/E, fitted with a backup pad known under the trade designation 3M 5876.

| Formulation | Size of Debris (Edge of Sanding) | Frequency |
|---|---|---|
| 1 | 1-2 mm | Light |
| Control | 2-4 mm | Moderate-Heavy |

(b) An abrasive disc known under the trade designation No-fil Adalox A273 Plain, having grade 320-A abrasive particles and a PSA backsize coating for attachment to an abrading device known under the trade designation AirWal Model TA 150, was attached to a backup pad known by the trade designation 3M 5576.

| Formulation | Flat Sanding of Debris | Frequency | Appearance of disc centre |
|---|---|---|---|
| 1 | 0.5 mm | Light | Light Dust |
| coated abrasive disc, trade designation Norton A273 | 1 mm | Moderate | Swirl marked* |

* "Swirl marked" is an indication of poor loading resistance.

I claim:

1. An abrasive element of the type including a substrate and a plurality of abrasive particles attached thereto by an organic binding medium, the abrasive element comprising a fluorochemical compound either admixed with the organic binding medium, attached to an exposed surface of the organic binding medium, or both, the fluorochemical compound selected from the group consisting of compounds comprising a fluorinated aliphatic group attached to a polar group or moiety and compounds having a molecular weight of at least about 750 and comprising a non-fluorinated polymeric backbone having a plurality of pendant fluorinated aliphatic groups comprising the higher of
   (a) a minimum of three C—F bonds, or
   (b) in which 25% of the C—H bonds have been replaced by C—F bonds such that the fluorochemical compound comprises at least 15% by weight of fluorine.

2. An abrasive element according to claim 1 wherein the compound having a molecular weight of at least 750 comprises a copolymer of fluorinated and non-fluorinated monomers.

3. An abrasive element according to claim 1 wherein the compound having molecular weight of at least 750 is selected from the group consisting of fluorinated acrylates and modified acrylates, fluorinated urethanes, fluorinated polyesters, fluorinated polycarbodiimides and copolymers thereof.

4. An abrasive element according to claim 1 wherein the compound having a molecular weight of at least 750 comprises fluorinated acrylate monomers having a nucleus of general formula (I):

$$R_f-(CH_2)_m-O-\overset{\overset{\displaystyle O}{\|}}{C}-\overset{\overset{\displaystyle X}{|}}{C}=CH_2 \qquad (I)$$

wherein:

$R_f$ represents a fluoroaliphatic group, x is selected from the group consisting of hydrogen and comprising up to 5 carbon atoms, and, m is 0, 1 or 2.

5. An abrasive element according to claim 1 wherein the compound having a molecular weight of at least 750 comprises fluorinated acrylate monomers having a nucleus of general formula (II):

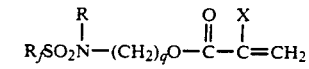

(II)

wherein;

x is selected from the group consisting of hydrogen and alkyl groups comprising up to 5 carbon atoms, $R_f$ represents a fluoroaliphatic group, R represents an alkyl group, comprising up to 5 carbon atoms, and q is an integer from 1 to 11.

6. An abrasive element according to claim 1 wherein the compound having a molecular weight of at least 750 and is selected from the group consisting of homopolymers and copolymers of perfluoro-octylsulphonamidoethyl acrylate.

7. An abrasive element according to claim 1 wherein the fluorochemical compound comprises one or more fluorinated aliphatic groups and the polar group or moiety is selected from the group consisting of carboxylic acid and salts thereof, sulphonic acid and salts thereof, phosphoric acid and salts thereof, acid halides, sulphonyl halides, esters, ethers, amides, sulphonamides, polyethers, urea, carbonates, urethanes and carbamates.

8. An abrasive element according to claim 1 wherein the organic binding medium additionally comprises an anti-static agent selected from the group consisting of carbon black graphite and metal flakes.

9. An abrasive element according to claim 1 wherein the substrate is in the form of a pad, disc, sheet, block, belt or a rigid or flexible three dimensional array of fibres.

10. An abrasive element according to claim 1 wherein the organic binding medium comprises a first layer attached to the substrate and second layer attached to the first layer and wherein the fluorochemical compound is absent from the first layer.

11. An abrasive element according to claim 10 wherein the second layer comprises:

(a) at least 20% binder by weight of the total solids of the composition, and, (b) at least 0.05% fluorochemical compound by weight of the total solids of the composition.

12. An abrasive element according to claim 11 wherein the second layer comprises:

(a) from 35 to 99% binder by weight of the total solids of the composition, and, (b) from 0.2 to 5% fluorochemical compound by weight of the total solids of the composition.

13. An abrasive element according to claim 1 wherein the organic binding medium comprises a first layer attached to the substrate, a second layer attached to the first layer, the second layer having an exposed surface, and a third layer attached to the exposed surface of the second layer, the third layer comprising said fluorochemical compound.

14. An abrasive element according to claim 13 wherein the third layer comprises:

(a) at least 0.5% binder by weight of the total solids of the composition, and, (b) at least 0.05% fluorochemical compound by weight of the total solids of the composition.

15. An abrasive element according to claim 14 wherein the third layer comprises:

(a) from 1 to 80% binder by weight of the total solids of the composition, and, (b) from 0.2 to 80% fluorochemical compound by weight of the total solids of the composition.

16. An abrasive element according to claim 1 wherein the organic binding medium additionally comprises from 40 to 99% of the total solids of the composition of a fatty acid salt.

17. An abrasive element according to claim 16 wherein the fatty acid salt is selected from the group consisting of calcium stearate, calcium oleate, calcium laurate, calcium myristate and calcium palmitate.

18. An abrasive element according to claim 16 wherein the organic binding medium additionally comprises a fatty acid salt of general formula (III):

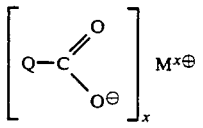

(III)

wherein;

Q is selected from the group consisting of a saturated or unsaturated hydrocarbon group having a chain length of from 9 to 24 carbon atoms, x has integral values from 1 to 4, and, M is selected from the group consisting of a metal and ammonium cations.

19. An abrasive element according to claim 18 wherein;

M is selected from the group consisting of Al, Ba, Zn, Mg, Ca, Na, Li, Zr, Pb and $NH_4$.

20. An abrasive element according to claim 18 wherein Q represents a hydrocarbon group having a nucleus of one of the following general formulae: $C_nH_{2n+1}$, $C_nH_{2n-1}$, $C_nH_{2n-3}$ and $C_nH_{2n-5}$, wherein n has integral values of from 9 to 24.

21. A method of preparing an abrasive element having a reduced propensity to loading, the abrasive element of the type including a substrate and a plurality of abrasive particles attached to the substrate by an organic binding medium, the method comprising admixing a fluorochemical compound the organic binding medium, wherein the fluorochemical compound is selected from the group consisting of compounds comprising a fluorinated aliphatic group attached to a polar group or moiety and compounds having a molecular weight of at least about 750 and comprising a non-fluorinated polymeric backbone having a plurality of pendant fluorinated aliphatic groups comprising the higher of (a) a minimum of three C—F bonds, or (b) in which 25% of the C—H bonds have been replaced by C—F bonds such that the fluorochemical compound comprises at least 15% by weight of fluorine.

22. A method of preparing an abrasive element according to claim 21 wherein the organic binding medium comprises a first layer attached to the substrate and a second layer attached to the first layer and wherein the fluorochemical compound is absent from the first layer.

23. A method of preparing a abrasive element according to claim 21 wherein the binding medium comprises a first layer attached to the substrate, a second layer attached to the first layer, and a third layer attached to the second layer, and wherein the fluorochemical compound is absent form the first and second layers.

24. A method of preparing a abrasive element having a reduced propensity to loading, the abrasive element of the type including a substrate and a plurality of abrasive particles attached to the substrate by an organic binding medium, wherein the method comprises applying a fluorochemical compound to the element in an aqueous dispersion or emulsion.

25. A method of preparing an abrasive element according to claim 24 wherein the aqueous dispersion or emulsion additionally comprises a fatty acid salt.

* * * * *

UNITED STATES PATENT AND TRADEMARK OFFICE

CERTIFICATE OF CORRECTION

PATENT NO. : 5,164,265

DATED : November 17, 1992

INVENTOR(S) : Roy Stubbs

It is certified that error appears in the above-identified patent and that said Letters Patent is hereby corrected as shown below:

| | |
|---|---|
| On the title page, Item [57] Abstract | Lines 15, 17 and 22, insert the word "fluorochemical" immediately preceding the word "compound" |
| Col. 1, line 48 | "poly(tetrafluoro ethy-" should read -- poly(tetrafluoroethy- -- |
| Col. 3, line 41 | "Polymeric" should read -- polymeric -- |
| Col. 8, line 43 | insert a --(-- before the word "tradename" |
| Col. 8, line 44 | insert a --)-- between "71322" and ":" |
| Col. 11, line 21 | insert a --(-- before the word "Grade" |
| Col. 16, line 26 | insert after "of": -- fluorochemical-acrylate dispersions, trade designation -- |

UNITED STATES PATENT AND TRADEMARK OFFICE

CERTIFICATE OF CORRECTION

PATENT NO. : 5,164,265

DATED : November 17, 1992

INVENTOR(S) : Roy Stubbs

It is certified that error appears in the above-indentified patent and that said Letters Patent is hereby corrected as shown below:

Col. 16, line 41 "252B" should read -- 352 --

Signed and Sealed this

Eighth Day of February, 1994

Bruce Lehman

*Attest:*

BRUCE LEHMAN

*Attesting Officer*

*Commissioner of Patents and Trademarks*